United States Patent [19]

Young et al.

[11] 4,260,364

[45] Apr. 7, 1981

[54] BURNER FOR FLASH SMELTING FURNACE

[75] Inventors: Charles E. Young, Copper Cliff; Charles D. Dobson, Sudbury, both of Canada

[73] Assignee: The International Nickel Company Inc., New York, N.Y.

[21] Appl. No.: 30,774

[22] Filed: Apr. 17, 1979

[30] Foreign Application Priority Data

Apr. 17, 1978 [CA] Canada ..... 301221

[51] Int. Cl.[3] ..... F23D 11/36

[52] U.S. Cl. ..... 431/160; 431/187; 110/264; 110/265

[58] Field of Search ..... 110/263, 264, 265, 266, 110/347, 182.5; 431/160, 187; 239/427.3, 427, 430, 433; 406/144, 108

[56] References Cited

U.S. PATENT DOCUMENTS

| | | | |
|---|---|---|---|
| 1,173,708 | 2/1916 | Chance | 110/347 |
| 1,213,820 | 1/1917 | Bergman | 110/265 |
| 2,212,004 | 8/1940 | Berthiaume et al. | 431/187 |
| 3,050,374 | 8/1962 | Burt et al. | 431/187 |
| 3,309,866 | 3/1967 | Kydd | 110/264 |
| 3,716,003 | 2/1973 | Battcock | 110/265 |
| 3,782,884 | 1/1974 | Shumaker | 431/187 |

FOREIGN PATENT DOCUMENTS

| | | | |
|---|---|---|---|
| 501150 | 1/1920 | France | 110/265 |
| 36444 | 2/1930 | France | 110/264 |
| 162270 | 5/1922 | United Kingdom | 110/264 |

*Primary Examiner*—Joseph Man-Fu Moy

*Attorney, Agent, or Firm*—R. J. Kenny; E. C. MacQueen

[57] ABSTRACT

A flash smelting burner is provided which consists of an assembly of feed pipes for solids and gas, which discharge into a mixing tunnel, the feed pipes being concentric at the point of discharge so that gas is fed into the mixing tunnel from an annular opening between the feed pipes, the solids feed pipe having a bend therein and being provided with apertures which enable a small proportion of the gas stream to enter the solids feed pipe at the bent region thereof.

5 Claims, 2 Drawing Figures

BURNER FOR FLASH SMELTING FURNACE

FIELD OF THE INVENTION

The present invention relates to apparatus for flash smelting sulfide ores and concentrates, and more particularly to an improved construction for burners which are adapted to be inserted through the side wall of a flash smelting furnace.

BACKGROUND OF THE INVENTION

Flash smelting entails injecting a sulfidic material into a furnace space with the aid of a stream of oxidizing gas through appropriately designed burners, so that the injected feed "burns" while it is in a suspended state within the furnace chamber. One type of furnace that has been used for carrying out flash smelting on a commercial scale incorporates vertically disposed burners which inject the suspension of solids and gas vertically downwards into the shaft of the furnace. A second type of furnace employs burners which are inserted through a vertical wall of the furnace so as to inject the suspension in a generally horizontal direction. It is in association with the latter type of furnace that the burner of the present invention is particularly useful.

A detailed description of a furnace of the horizontal burner type, with which the present assignee has been associated for some time, can be found in the paper: "Oxygen Flash Smelting Swings Into Commercial Operation", *Journal of Metals* (1955) pp. 742–750. The furnace in question is one having a chamber in the shape of a rectangular room with an arched ceiling. Burners are provided in the shorter of the side walls, while the exhaust off-take is provided in the arched furnace roof. The furnace can be operated in a fully autogenous manner by using commercially pure (i.e., at least 95 percent) oxygen to inject the feed. Apart from obviating the need for additional fuel to maintain the smelting temperature, this method of operation offers the advantage of exhaust gases which are more concentrated in sulfur dioxide than would be the case if air were used instead of oxygen. As a result the flue gases are of lower volume and are more amenable to recovery of the sulfur dioxide therefrom.

It should be mentioned at this point that while the burner arrangement in the above described furnace is referred to for convenience as horizontal to distinguish it from the vertical burner arrangement, in practice it is preferred that the burner be tilted at a slight angle to the horizontal as described in co-pending Canadian application Ser. No. 281,906, of July 4, 1977, assigned in common with the present invention.

A burner which has been used in the horizontal burner apparatus described above can be descibed for simplicity as consisting of a generally cylindrical member which defines a mixing tunnel, and an assembly of co-axial pipes which abutt and communicate with one end of the mixing tunnel. The central pipe carries the particulate feed into the mixing tunnel, while the oxidant gas is discharged into the mixing tunnel through the annular space between the pipes. Because the mixing tunnel is disposed in an approximately horizontal direction, and because in general the particulate material to be smelted is fed under gravity from a point above the burner, the feed carrying pipe is not straight, but rather bent over at least a portion of its length. In using a burner of such design, the curvature of the feed pipe has been found to lead to problems. One of these is the tendency for the desired even flow of particles through the feed pipe to be adversely affected. A more serious problem is that abrasion of the wall of the mixing tunnel by the dry particulate solids tends to occur unless such solids are travelling in a direction which is substantially parallel to the axis of the mixing tunnel when they are discharged thereinto from the feed pipe. Such wear of the mixing tunnel wall can be quite extensive and places a severe limitation on the useful life of the burner.

OBJECT OF THE INVENTION

It is an object of the invention to provide an improved burner adapted to be disposed horizontally in a flash furnace, wherein the problem of internal abrasion of the wall of the mixing tunnel is minimized.

SUMMARY OF THE INVENTION

According to the invention, a burner adapted to be inserted in a side wall of a flash smelting furnace comprises:

means for defining a first passage through which in operation particulate solids flow towards said furnace;

means for defining a second passage through which in operation oxidant gas flows towards said furnace; and means for defining a mixing tunnel into which in operation solids and gas are fed from said first and second passages, and from which in operation solids-gas mixture is discharged into said furnace;

wherein said first passage-defining means comprises a tubular member having a bend therein, said second passage-defining means includes a housing surrounding said tubular member at least over a portion of the length of said tubular member which portion includes said bend, and wherein said tubular member is provided within the bent region thereof with at least one aperture in the tube wall remote from the center of curvature of said bend to enable in operation a portion of the oxidant stream to flow from said second passage into said first passage.

A preferred embodiment of the invention includes a mixing tunnel, the walls of which are water-cooled. The mixing tunnel is not cylindrical but frustro-conical so as to present an increasing cross-section in the direction of flow. The water cooling is provided by a jacket surrounding the mixing tunnel, and the outer wall of the jacket defines a second frustro-conical surface, the slope of which is opposite to and greater than that of the wall of the mixing tunnel. As a result of the configuration of the water jacket, the portion of the burner which in operation is inserted into the furnace wall possesses a slight taper which facilitates its insertion into and out of its mounted position while minimizing damage to the furnace refractory. The apertures provided in the solids feed pipe at the bent region thereof are preferably in the form of narrow slots. Oxygen, or other oxidant gas such as air, which passes into the feed pipe through these apertures serves a dual purpose. Firstly it provides a deflecting or cushioning action which aids the change in direction of the solids flowing past the bend. In addition, however, the oxygen or other gas mixes with the particulate feed, so that the latter acquires more aerated, better flowing characteristics. The overall result is that the solids are travelling substantially parallel to the mixing tunnel axis when they are picked up by the high-speed gas of the tunnel.

To aid in the understanding of the invention, a specific embodiment thereof will be described by way of example with reference to the accompanying drawings.

DETAILED DESCRIPTION OF THE EMBODIMENT

Figure 1:
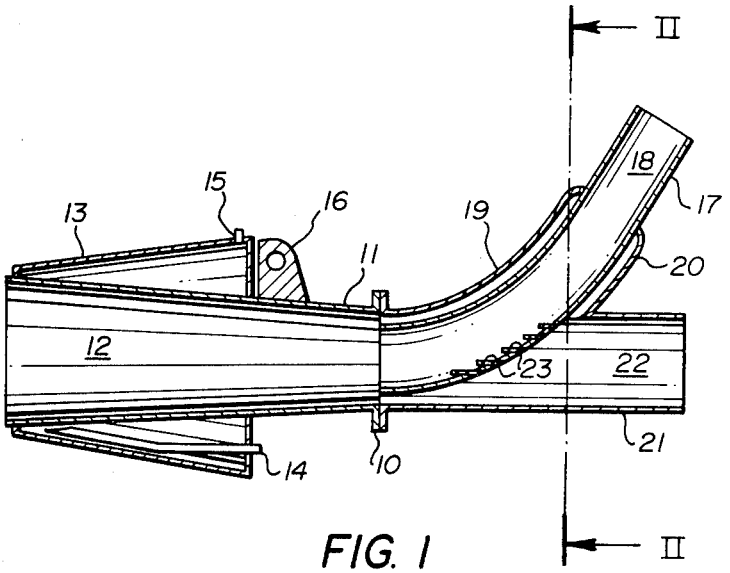
FIG. 1 illustrates a cross-sectional view of a burner in accordance with the invention.

The burner shown in FIG. 1 can be considered for the sake of description as consisting of a mixing section and a supply section, which constitute respectively the portions located to the left of and to the right of the flange 10 in the drawings. The mixing section includes a tube 11, the diameter of which increases outwardly from the flange 10 thereby defining a mixing chamber 12 of frustro-conical configuration. A cooling jacket 13 is provided on the exterior of the tube 11 and surrounds the portion thereof which in operation will be located within the furnace chamber. The cooling jacket is so shaped that the jacketed portion of the mixing section has a tapered outer surface for insertion into the furnace. An inlet 14 and an outlet 15 in the cooling jacket enable coolant, which in general will be water, to be circulated through the cooling compartment which is defined by the walls of the jacket 13 and the tube 11. A plate 16, fixedly attached to the upper surface of the tube 11, provides a lifting lug by means of which the burner assembly can be handled. Once the assembly has been inserted through the furnace wall, it is preferably secured to the furnace housing by means such as a chain which will ensure the desired proper alignment of the burner.

Figure 2:
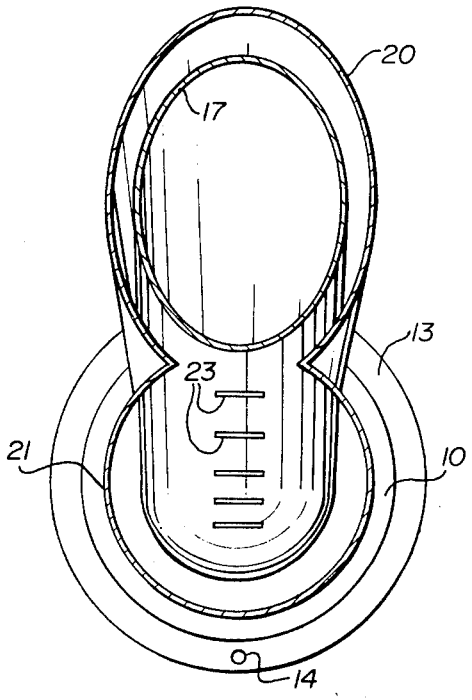
FIG. 2 illustrates another cross-sectional view of the same burner along the line II—II of FIG. 1.

The feed portion of the burner includes a solids feed pipe 17 which defines a passage 18 through which in operation the solid feed comprising sulfidic material and slag forming ingredients is fed. The tube 17 is bent through an arc of approximately 60° so as to receive the solids from a feed line discharging under gravity, and inject the solids in a generally horizontal direction into the mixing chamber 12. A housing 19 surrounds the lower portion of the pipe 17 and extends from the flange 10 to a point above the bent portion of the pipe 17. The housing comprises a pair of pipes 20 and 21 welded in communication with one another so as to define a passage 22 surrounding the pipe 17 and terminating as an annular opening at the flange 10. The pipe 17 is provided in its bent region with a series of slots 23 which are seen more clearly in the enlarged view of FIG. 2. Each of the slots 23 comprises a cut-out portion of the tube which has been produced by a saw-cut at a bias to the tube radius at the respective point. By use of a successively increasing cutting bias angle from the uppermost to the lowermost slot shown in FIG. 1, the slots are made to lie in a series of parallel planes which will be essentially horizontal when the burner is mounted in position.

The slots 23 extend over only a small portion of the circumference of the tube 17 and are relatively narrow. For example, in a particular embodiment of the burner design shown in the drawings, the solids feed pipe 17 was constructed from a tube of approximately 15 cm diameter, 20 cm diameter pipe was used for the tubes 20 and 21 constituting the housing, and each of the slots 23 comprised a saw-cut 5 cm long and 1.5 mm wide. The relative size of the slots ensures that only a minor portion of the oxidant gas, e.g., commercially pure oxygen, which is introduced into the tube 21 will flow into the passage 18 to provide the desired deflecting and aerating effect for the solids flowing therein, while the major part of the oxidant gas will flow externally of the tube 17 and mix with the solids only after the latter have been discharged into the mixing chamber 12.

The above-mentioned specific burner was inserted through the side wall of a furnace and disposed in such a way that the axis of symmetry of the mixing tunnel was inclined at an angle of 3°–4° below the horizontal. Testing of the burner under normal operating conditions showed a satisfactory flow of solids through the passage 18 with no tendency for solid particles to pass through the apertures 23 in view of the positive gaseous pressure in the passage 22.

Our tests indicate that a burner designed in accordance with the invention possesses a useful life much longer (e.g., 3 to 10 times longer) than burners used in the past. For example, whereas prior-used burners had an average life-expectancy of about 75 hours, we have found that with burners in accordance with the invention the mixing tunnel can be expected to last at least 200 hours and probably much longer. Moreover, we have found that after 800 hours of operation the feed section showed little sign of wear.

While the present invention has been described with reference to a preferred embodiment, it will be appreciated that various modifications may be made to the specific details of this embodiment, such as for example the configuration of the apertures in the side wall of the solids feed pipe, which apertures may comprise a series of circular holes rather than slots. Such modifications and others may be made without departing from the scope of the invention which is defined by the appended claims.

We claim:

1. A burner adapted to be inserted in a side wall of a flash smelting furnace comprising:

means for defining a first passage through which in operation particulate solids flow towards said furnace comprising a tubular member having a bend therein, said tubular member being provided within the bent region thereof with at least one aperture in the tube wall remote from the center of curvature of said bend; and means for defining a second passage through which in operation oxidant gas flows toward said furnace including a housing surrounding said tubular member at least over a portion of the length of said tubular member which portion includes said bend; and means for defining a mixing tunnel into which in operation solids and gas are fed from said first and second passages, and from which in operation solids-gas mixture is discharged into said furnace; and wherein said mixing tunnel-defining means comprises a frusto-conical member having its narrower extremity disposed towards and in fixed abuttment with said housing, and wherein said mixing tunnel-defining means is provided with an outer jacket and means for circulating cooling fluid within the space between said frusto-conical member of said jacket.

2. A burner as claimed in claim 1 wherein the portion of said tubular member surrounded by said housing extends from said bend to the extremity of said tubular member which communicates with said mixing tunnel, whereby in operation, oxidant gas is fed into said tunnel from an annular space between said tubular member and said housing.

3. A burner as claimed in claim 1 wherein said or each aperture comprises a slot in said tube wall.

4. A burner as claimed in claim 1 wherein said jacket comprises a frusto-conical outer wall having a slope that is opposite to and greater than the slope of said frusto-conical member.

5. A burner as claimed in claim 3 wherein said second passage-defining means also includes second tubular means communicating with said housing, said second tubular means having a longitudinal axis essentially in alignment with the longitudinal axis of said mixing tunnel and wherein a plurality of said slots are employed with each of said slots lying in one of a series of parallel planes, said planes being essentially parallel to the longitudinal axis of said second tubular means.

* * * * *